US006693950B2

(12) United States Patent
Fishman et al.

(10) Patent No.: US 6,693,950 B2
(45) Date of Patent: Feb. 17, 2004

(54) FURNACE WITH BOTTOM INDUCTION COIL

(75) Inventors: Oleg S. Fishman, Maple Glen, PA (US); Vitaly A. Peysakhovich, Moorestown, NJ (US)

(73) Assignee: Inductotherm Corp., Rancocas, NJ (US)

( * ) Notice: Subject to any disclaimer, the term of this patent is extended or adjusted under 35 U.S.C. 154(b) by 0 days.

(21) Appl. No.: 10/153,049

(22) Filed: May 21, 2002

(65) Prior Publication Data

US 2003/0002559 A1 Jan. 2, 2003

Related U.S. Application Data

(60) Provisional application No. 60/292,679, filed on May 22, 2001.

(51) Int. Cl.[7] ..... F27D 23/04; H05B 6/34

(52) U.S. Cl. ..... 373/146; 373/153

(58) Field of Search ..... 373/138, 146, 373/147, 151, 153, 155, 156, 7, 59, 158; 219/647, 648, 649, 650, 628; 266/234, 349, 216, 197, 900; 366/349, 147, 274; 75/10.14

(56) References Cited

U.S. PATENT DOCUMENTS

| | | | | | |
|---|---|---|---|---|---|
| 2,513,082 | A | * | 6/1950 | Dreyfus | 373/146 |
| 2,871,279 | A | * | 1/1959 | Ladell | 373/158 |
| 2,875,261 | A | * | 2/1959 | Hanff | 373/146 |
| 3,199,842 | A | * | 8/1965 | Karlsson et al. | 373/146 |
| 3,671,029 | A | * | 6/1972 | Karlsson et al. | 266/234 |
| 4,033,562 | A | * | 7/1977 | Collin | 373/7 |

* cited by examiner

*Primary Examiner*—Tu Ba Hoang
(74) *Attorney, Agent, or Firm*—Philip O. Post

(57) ABSTRACT

An induction furnace is provided with a bottom induction coil to melt, heat and/or stir an electrically conductive material placed in the furnace. The furnace is particularly useful for electrically conductive materials having a relatively low value of thermal conductivity, such as aluminum or an aluminum alloy.

10 Claims, 8 Drawing Sheets

FURNACE WITH BOTTOM INDUCTION COIL

CROSS-REFERENCE TO RELATED APPLICATIONS

This application claims the benefit of U.S. Provisional Application No. 60/292,679, filed May 22, 2001.

FIELD OF THE INVENTION

The present invention generally relates to electric induction melting, heating and stirring of an electrically conductive material, and in particular to an induction furnace with a bottom induction coil.

BACKGROUND OF THE INVENTION

A material with a relatively low value of thermal conductivity, such as aluminum, can be melted and heated in a fossil fuel-fired reverberatory furnace. The salient features of a fossil fuel-fired reverberatory furnace 100 are illustrated in FIG. 1. Crucible 110 is configured to accommodate a shallow depth of molten bath 120 of the material. Heat generated by fossil fuel-fired burners 115 disposed above the surface of the bath reverberates in the volume bounded by crucible lid 125, the surface of the bath, and the side wall of crucible 110. The heat is transferred by conduction throughout the melt, with the shallow depth of the bath minimizing heat transfer time. To facilitate heat transfer from the upper to the lower regions of the bath, a mechanical stirrer 130 (shown diagrammatically in FIG. 1) is used to circulate the bath If the molten bath is aluminum, the entire bath must be kept at least above the melting point of aluminum, which is nominally 661° C. Material charge can be added to the crucible by removing lid 125 and placing the charge in the crucible. Molten material can be tapped from the crucible at selectively closeable outlet 162.

Melting and heating aluminum in a reverberatory furnace is an inefficient process in terms of energy input, time and simplicity of operation. Additionally, mechanical stirrers are high maintenance and high failure items due to submersed operation in the molten bath. The present invention addresses these problems by providing an apparatus for and method of melting, heating and/or stirring aluminum in an efficient manner by magnetic field induction heating. The apparatus and method are also of particular value for the melting, heating and/or stirring of other metals besides aluminum and its alloys, and other electrically conductive materials having a relatively low value of thermal conductivity.

SUMMARY OF THE INVENTION

In one aspect, the present invention is apparatus for and method of melting, heating and/or stirring an electrically conductive material in an induction furnace having a bottom induction coil. The coil is placed between a bottom support structure and a magnetic flux concentrator so that a magnetic field generated external to the coil, by a current flowing through it, is directed towards the material in the crucible of the furnace to magnetically couple with it and inductively heat the material. The coil may consist of multiple active and passive coil sections. An active coil section is impedance matched to the input of an ac power supply, and the passive coil section forms an inductive/capacitive resonant circuit. Magnetic coupling of the passive coil section with a magnetic field generated by current in the active coil generates a secondary magnetic field. The fields generated by the active coil section and the passive coil section are directed towards the material in the crucible of the furnace to inductively heat the material. These and other aspects of the invention will be apparent from the following description and the appended claims.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 4(*b*) is a cross section elevation view of the bottom support structure of FIG. 4(*a*) as indicated by section line A—A in FIG. 4(*a*).

FIG. 5(*b*) is a diagram of another arrangement of an induction coil used with the induction furnace of the present invention wherein the coil comprises an active coil section and a passive coil section.

FIG. 6(*b*) is a diagram of another arrangement of an induction coil used with the induction furnace of the present invention wherein the coil comprises an active coil section and a passive coil section.

DETAILED DESCRIPTION OF THE INVENTION

Figure 3:
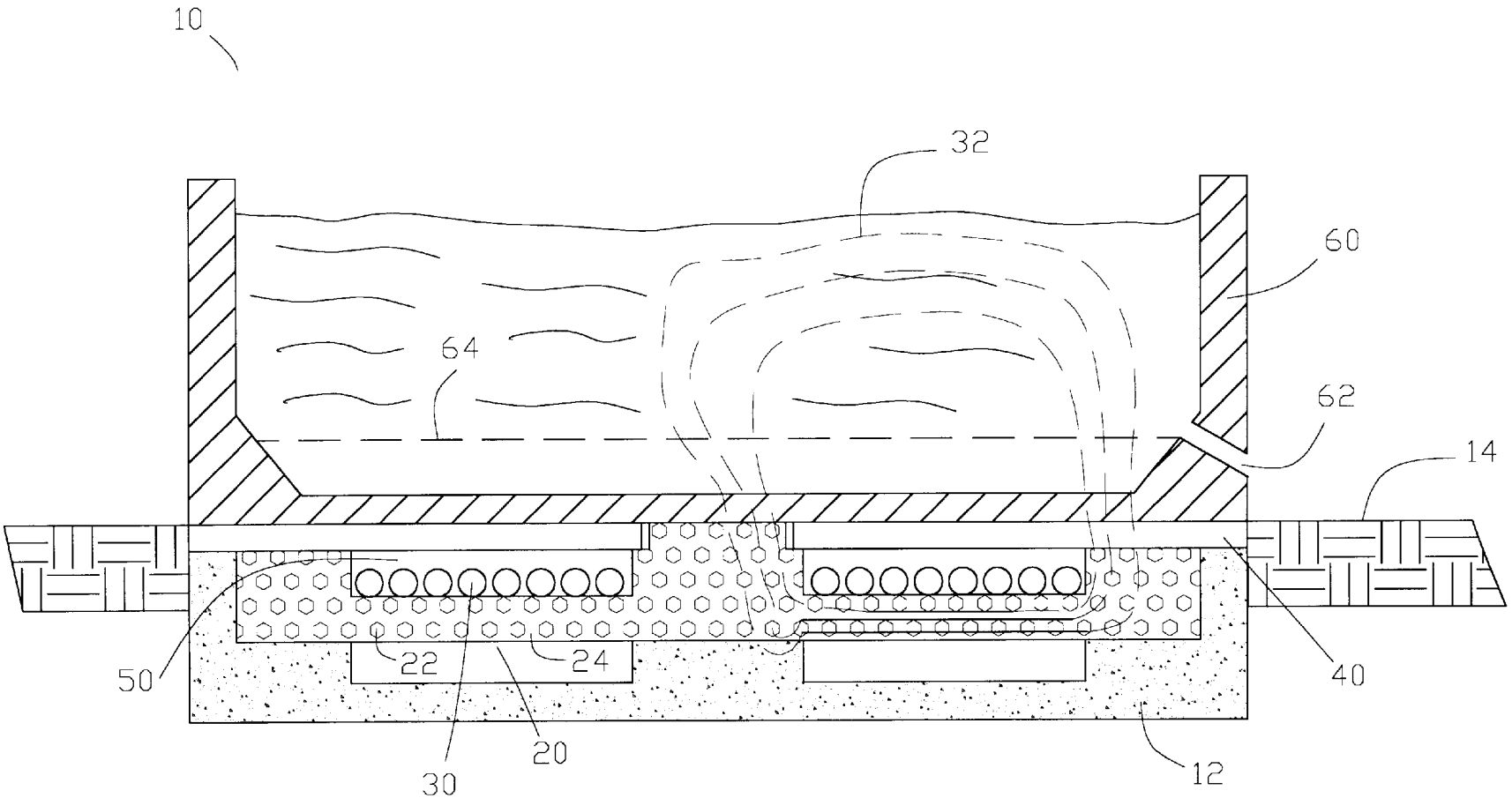
FIG. 3 is a cross sectional view of one example of the induction furnace of the present invention.
Figure 4B:
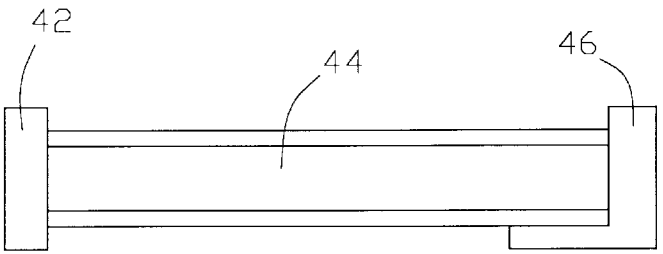
FIG. 4(*a*) is a plan view of one example of a bottom support structure for use with an induction furnace of the present invention.
Figure 4A:
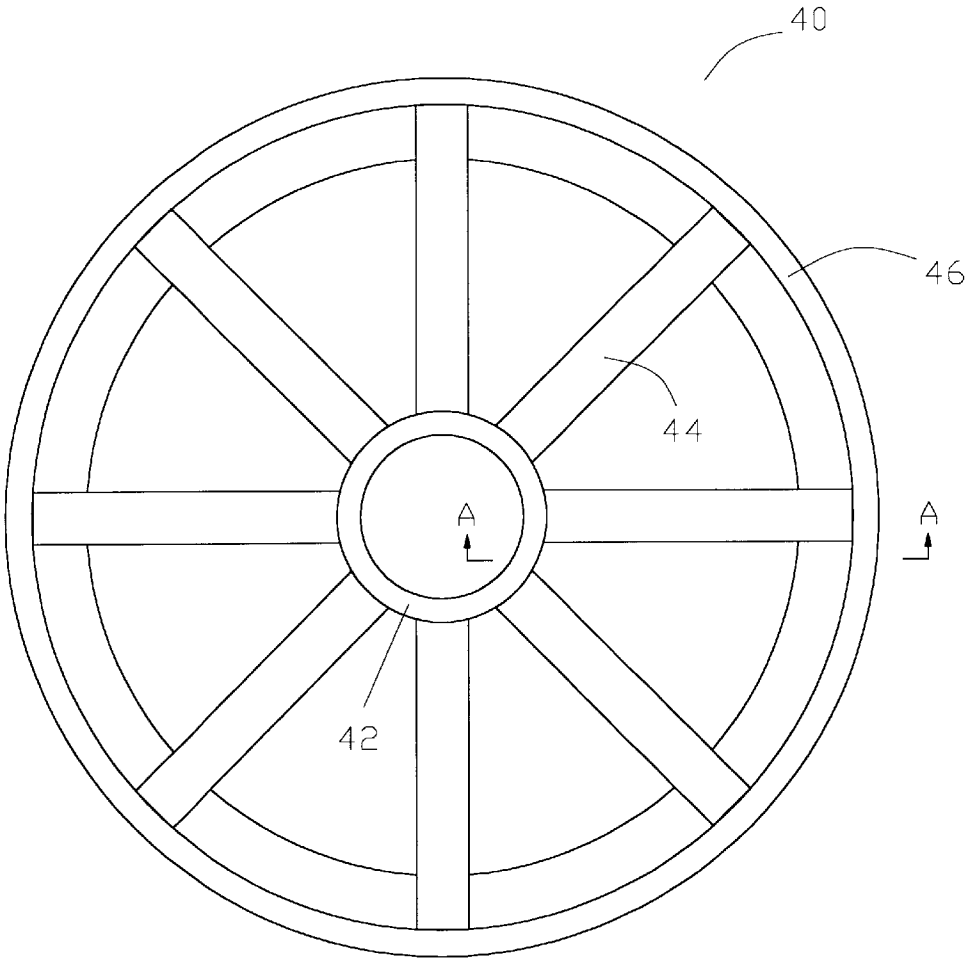

FIG. 3, FIG. 4(*a*) and FIG. 4(*b*) illustrate one example of the induction furnace 10 of the present invention. While aluminum is a preferred electrically conductive material for heating, melting and/or stirring in furnace 10, the choice of material does not limit the scope of the invention. Further the term "aluminum" as used herein, applies to pure aluminum and aluminum alloys without limitation to composition. Furnace foundation 12 can be provided below grade 14, and may be formed from any suitable load bearing material such as concrete.

Crucible 60 is formed from a suitable refractory material. The crucible can be provided with a plugged or valved outlet 62 that normally opens into the interior of the crucible above a heel line 64 (indicated by dashed line in FIG. 3). Molten aluminum below the heel line, called remnant melt, is left in the crucible when melt above the heel line is tapped through outlet 62 to provide a minimum inductively coupled load for a magnetic field generated by current flowing through induction coil 30. A suitable ac power supply (not shown in the figures) is connected to the coil to provide the current.

Magnetic flux concentrator 20 is disposed on foundation 12 as shown in FIG. 3. In this non-limiting example of the invention, the flux concentrator is in the shape of a ring with a raised central section and raised outer section that form between them a space within which induction coil 30 is coiled. Preferably, but not necessarily, flux concentrator 20 is formed from a plurality of discrete ferromagnetic elements 22, such as steel pellets, disposed in a non-electrically conductive matrix material 24, such as a composite epoxy material. In this embodiment of the invention, flux concentrator 20 can be manufactured in cast form.

As shown in FIG. 3, induction coil 30 is disposed below the bottom of the furnace and on top of flux concentrator 20. Coil 30 is generally formed by a spirally wound inductor coil that forms a "pancake" configuration with the inductor coil lying substantially in the same horizontal plane. Coil 30 may optionally be embedded in an electrically non-conductive material, such as an epoxy composition, or disposed within plenum 50 as shown in FIG. 3. Crucible 60 is supported on bottom support structure 40. In this example of the invention, as shown in FIG. 4(*a*) and FIG. 4(*b*), bottom support structure 40 comprises an inner central ring element 42, a plurality of transverse support elements 44 and an outer perimeter ring element 46. Transverse support elements 44, which may be structural steel I-beams, are connected at one end to inner central ring element 42, and at the opposing end to outer perimeter ring element 46. If the transverse support elements 44 are composed of structural steel or other electrically conductive material, the width of each element 44 must be minimized so that they do not create a significant low reluctance path for the magnetic field created by an ac current flow through coil 30. Further, if elements 44 are ferromagnetic, they must be connected to outer perimeter ring element 46 via a non-electrically conductive element, such as an electrical isolating pad in a bolted connection between element 44 and element 46, to prevent the formation of a significant low reluctance path among transverse support elements 44 and the outer perimeter ring element. The remaining volume of the disc-shaped bottom support structure 40 may be filled with a non-electrically conductive material, for example, by casting assembled elements 42, 44 and 46 in a concrete composition to provide a stronger support base for crucible 60. The configuration of bottom support structure 40 in this example may be of other shapes and configurations as long as the structure provides structural support for the crucible and allows sufficient passage of the magnetic field generated by coil 30 for magnetic coupling with the melt contained in the crucible.

Representative magnetic flux lines 32 (shown in dashed lines in FIG. 3) illustrate (in cross section) for the right side of induction furnace 10 the magnetic field that is created when ac current is supplied to coil 30 from a suitable power supply. The eddy current induced in the molten aluminum produces electromagnetic forces that will effectively stir the molten aluminum without the need for stirring apparatus. Further the frequency of the ac current may be varied to enhance the electromagnetic stirring effect, if desired.

Induction coil 30 may be formed from either hollow fluid-cooled conductors, or preferably, air-cooled conductors. For air-cooled conductors, Litz wire may be used. In other applications, coil 30 may be of other shapes, such as rectangular in cross section, and may be formed, for example, from a flexible solid conductor, such as copper.

Induction coil 30 can be composed of one or more separate coil sections that are connected to one or more suitable power supplies. Induction coil 30 may also be composed of two or more separate coil sections wherein one or more of the coil sections are connected to a suitable power supply (active coils) and the remaining coils are passive coils connected to a capacitive element to form a resonant inductive/capacitive (L-C) circuit. Magnetic fields generated by current flow in the one or more active coils will induce secondary current flow in the one or more passive coils. Magnetic fields generated by current flows in the active and passive coil sections are directed towards the melt contained in the crucible and magnetically couple with the melt to inductively heat it.

Figure 5A:
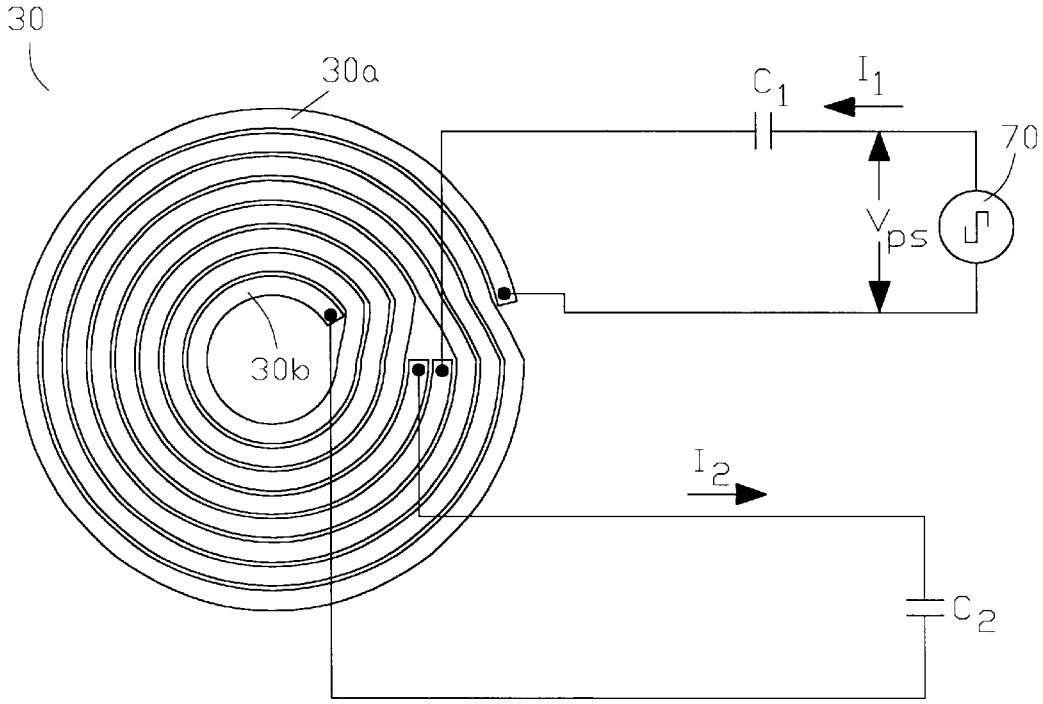
FIG. 5(*a*) is a diagram of one arrangement of an induction coil used with the induction furnace of the present invention wherein the coil comprises an active coil section and a passive coil section.
Figure 5B:
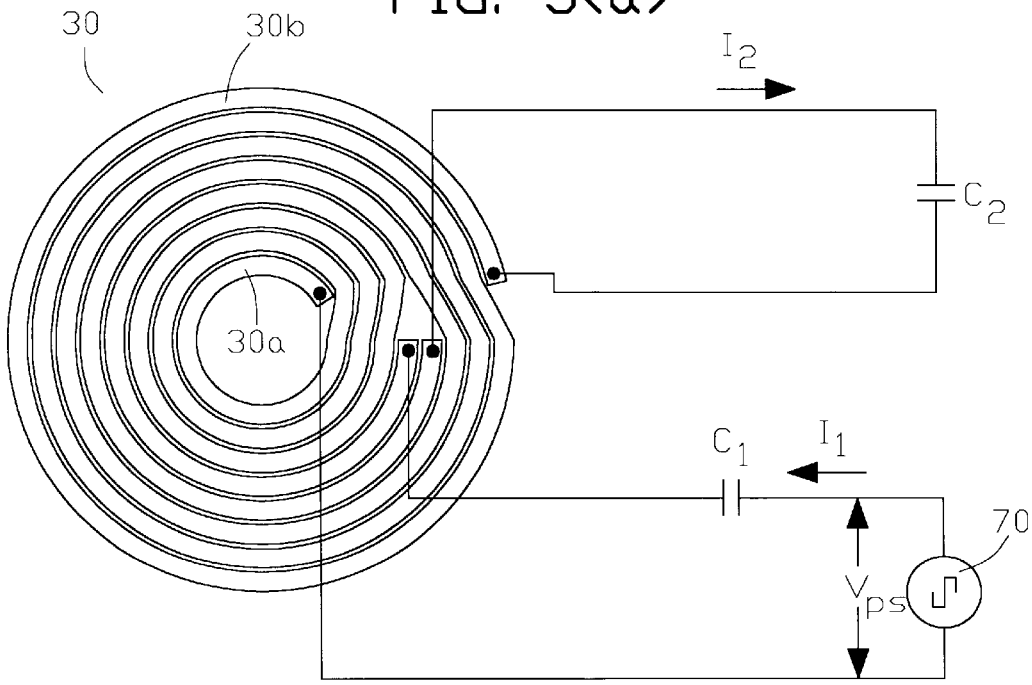

FIG. 5(*a*) and FIG. 5(*b*) illustrate examples of an induction coil 30 with active coil section 30*a* and passive coil section 30*b*. Ac current, $I_1$, provided from power supply 70 to coil section 30*a* through load matching capacitor $C_1$ creates a magnetic field that induces a current, $I_2$, in coil section 30*b*, which is series connected with resonant capacitor $C_2$ to form an L-C resonant circuit.

Figure 6A:
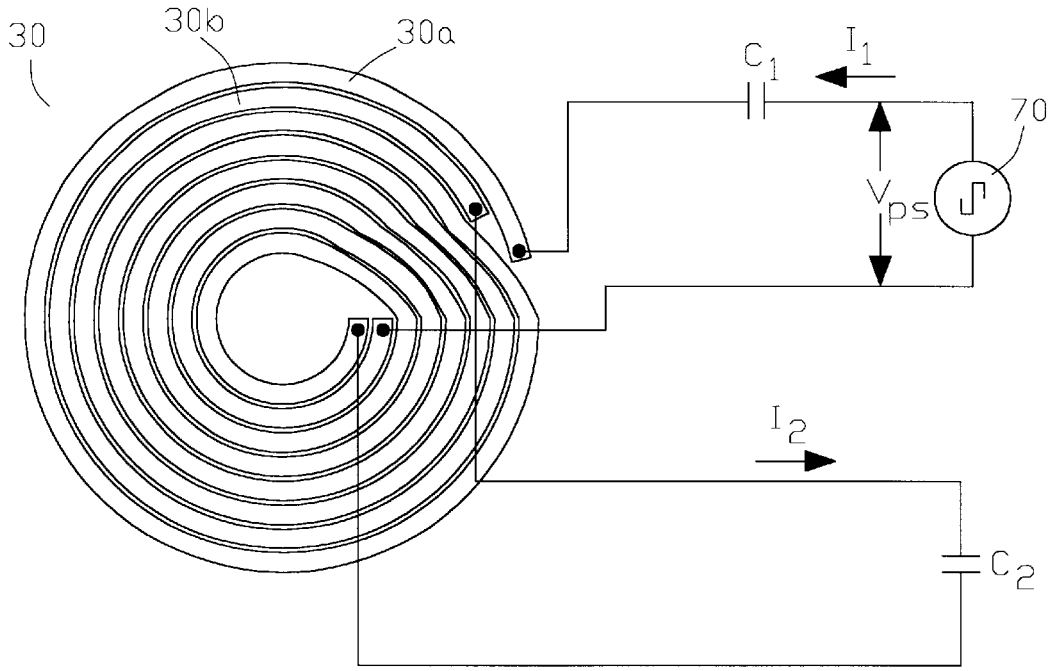
FIG. 6(*a*) is a diagram of another arrangement of an induction coil used with the induction furnace of the present invention wherein the coil comprises an active coil section and a passive coil section.
Figure 6B:
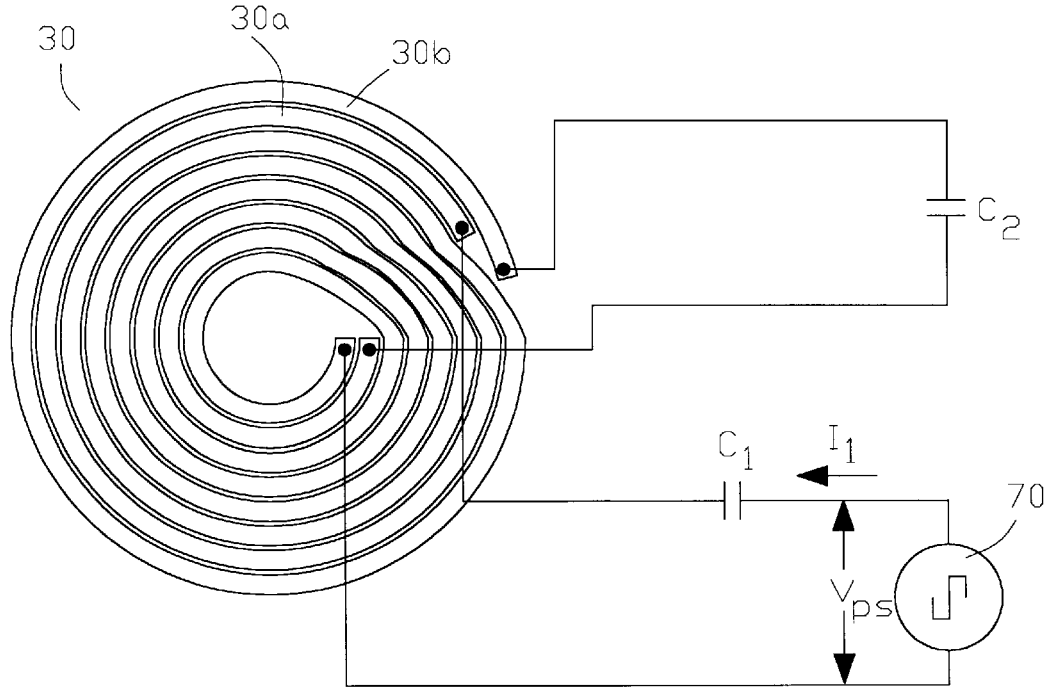

In FIG. 6(*a*) and FIG. 6(*b*) active coil section 30*a* and passive coil section 30*b* are planarly interspaced with each other, rather than being disposed planarly interior and exterior to each other as shown in FIG. 5(*a*) and FIG. 5(*b*). In other examples of the invention, the active and passive coil sections may be disposed in other arrangements such as overlapped active and passive coil sections.

Figure 8:
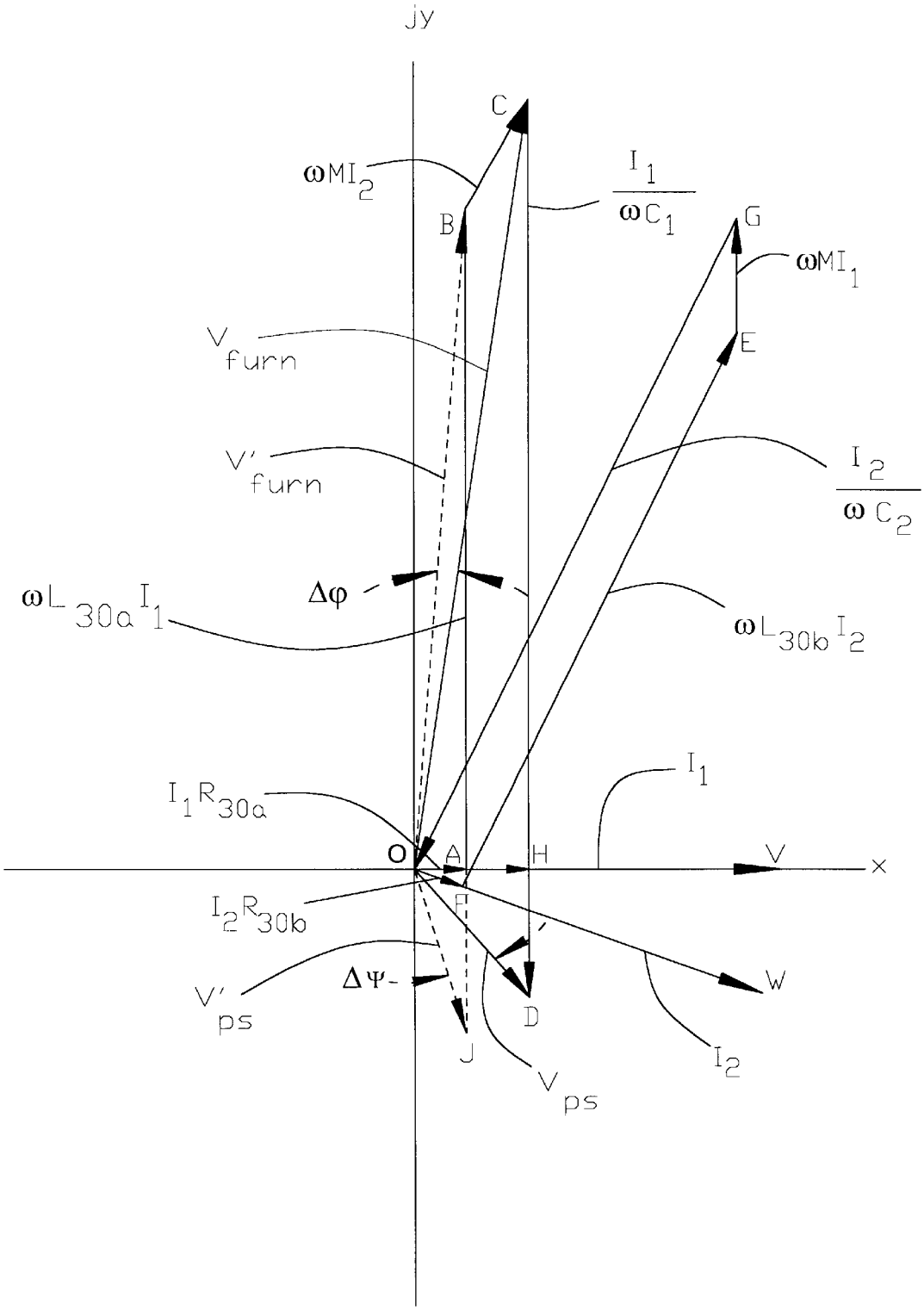
FIG. 8 is a vector diagram illustrating the advantages of an induction coil with an active coil section and a passive coil section for use with the induction furnace of the present invention.

The advantage of active and passive coil sections can be further appreciated from the vector diagram shown in FIG. 8. In the figure, with respect to the circuit formed by the active coil circuit, vector OV represents current $I_1$ in active coil section $L_{30a}$ as illustrated in FIG. 5(*a*), FIG. 5(*b*), FIG. 6(*a*) and FIG. 6(*b*). Vector OA represents the resistive component of the active coil's voltage, $I_1R_{30a}$ ($R_{30a}$ not shown in the figures). Vector AB represents the inductive component of the active coil's voltage, $\omega L_{30a}I_1$ (where $\omega$ equals $2\pi$ times f, which is the operating frequency of power supply 70). Vector BC represents the voltage, $\omega MI_2$, induced by the passive coil section $L_{30b}$ onto active coil section $L_{30a}$. Vector CD represents the voltage, $I_1/\omega C_1$, on series capacitors $C_1$ connected between the output of power supply 70 and active coil section $L_{30a}$. Vector OD represents the output voltage, $V_{ps}$, of power supply 70.

With respect to the circuit formed by the passive coil circuit, vector OW represents current $I_2$ in passive coil section $L_{30b}$ that is induced by the magnetic field produced by current $I_1$. Vector OF represents the resistive component of the passive coil's voltage, $I_2R_{30b}$ ($R_{30b}$ not shown in the figures). Vector FE represents the inductive component of the passive coil's voltage, $\omega L_{30b}I_2$. Vector EG represents the voltage, $\omega MI_1$, induced by the active coil section $L_{30a}$ onto passive coil section $L_{30b}$. Vector GO represents the voltage, $I_2/\omega C_2$, on capacitor $C_2$, which is connected across passive coil section $L_{30b}$.

The active coil circuit is driven by voltage source, $V_{ps}$, while the passive coil loop is not connected to an active energy source. Since the active and passive coils are mutually coupled, vector BC is added to vector OB, which represents the voltage ($V'_{furn}$) across an active coil section in the absence of a passive capacitive coil circuit, to result in vector OC, which is the voltage ($V_{furn}$) across an active coil section with a passive capacitive coil circuit. The resultant induction furnace voltage, $V_{furn}$, has a smaller lagging power factor angle, $\phi$ (counterclockwise angle between the x-axis and vector OC), than the conventional furnace as represented by vector OB (shown in dashed lines). As illustrated in FIG. 8, there is a power factor angle improvement of $\Delta\phi$.

With active and passive coil sections, the inductive impedance in the passive coil is substantially compensated for by the capacitive impedance (i.e., $\omega L_{30b} \approx 1/\omega C_2$). The uncompensated resistive component, $R_{30b}$, in the passive coil circuit is reflected into the active coil circuit by the mutual inductance between the two circuits, and the effective active coil circuit's resistance is increased, thus improving the power factor angle, or efficiency of the coil system.

Further the power factor angle, $\psi$, for the output of the power supply improves by $\Delta\psi$ as illustrated by the angle between vector OJ (the resultant vector ($V'_{ps}$) of resistive component vector OA and capacitive component vector AJ in the absence of a passive furnace coil circuit) and vector OD (the resultant vector ($V_{ps}$) of resistive component vector OH and capacitive component vector HD with the passive furnace coil circuit).

In FIG. 3, plenum 50, which is bounded by flux concentrator 20 and bottom support structure 40, provides a gaseous (typically, but not limited to air) flow cavity through which cooling air can be provided by a forced air mechanical system (not illustrated in the drawings) to remove heat generated in induction coil 30.

Normally a lid (not shown in FIG. 3) is provided over the top of furnace 10 to inhibit heat loss from the melt. The lid is removable by means of a mechanical handling system to permit the introduction of additional feedstock into the furnace.

Figure 7:
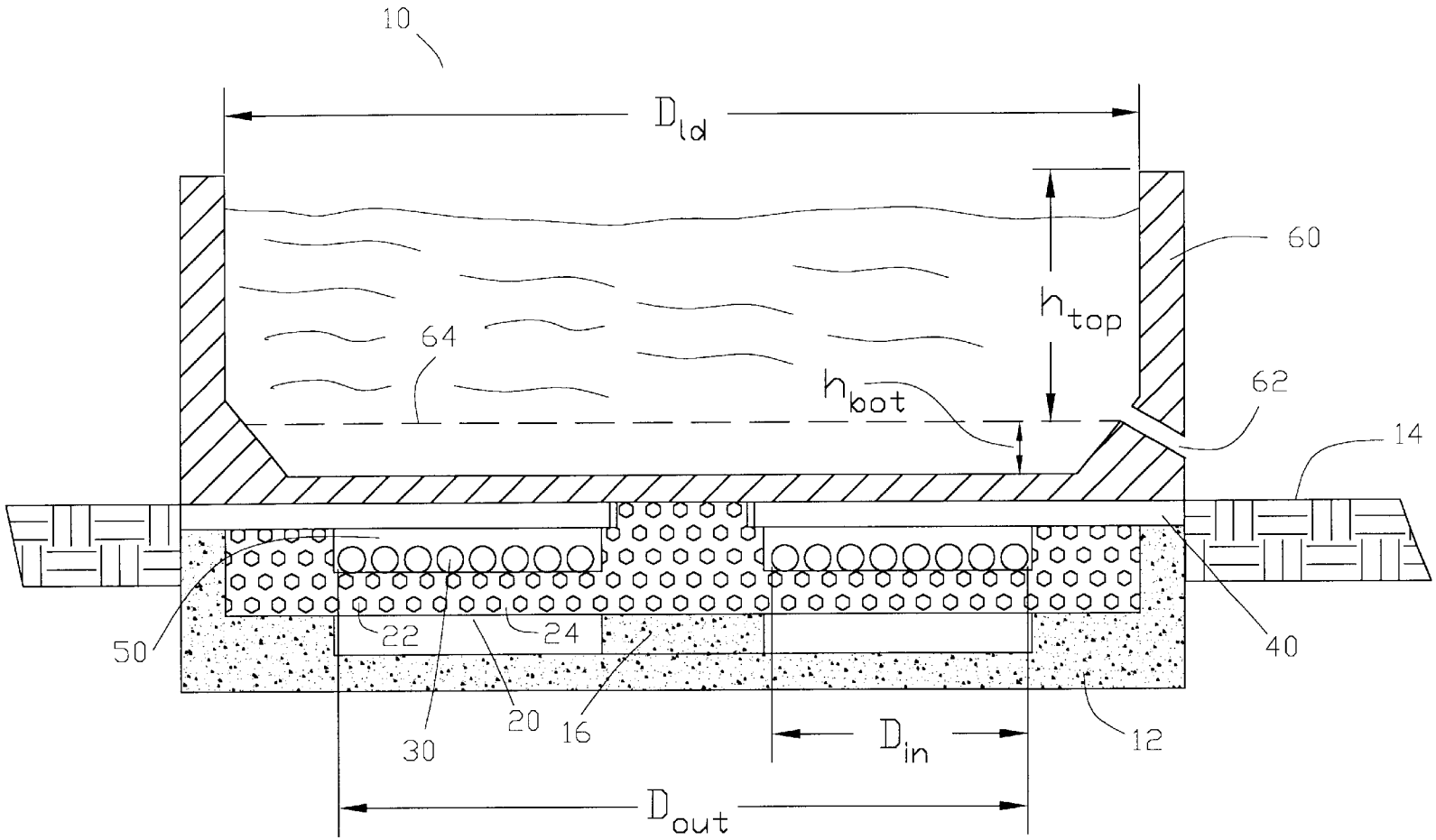
FIG. 7 is a cross sectional view of one application of the induction furnace of the present invention.

The following are two exemplar applications of the induction furnace 10 of the present invention. In both applications, induction furnace 10 has an aluminum capacity of 125 thousand tons (MT), a minimum remnant melt of 20 to 25 MT and a productivity rate of 10 MT/hr. A density of 2,370 kg/m$^3$ and energy consumption of 320 kW-hrs/ton was used for molten aluminum. In both applications, the parameters of coil 30 in table 1 apply, as further identified in FIG. 7.

TABLE 1

Coil Parameters

| Coil Parameter | Value of Parameter |
|---|---|
| Inner Diameter ($D_{in}$) | 2,000 mm |
| Outer Diameter ($D_{out}$) | 6,400 mm |
| Overall Length of Coil | 1,300 mm |
| Coil Cross Sectional Diameter | 50 mm |

Coil 30 in both applications is a circular, insulated power cable suitable for use at 60 Hertz, and at the voltage and current identified below. Magnetic flux concentrator 20 in both applications has an approximate relative magnetic permeability of 4.

In both sample applications, the molten metal load, which takes on the general cylindrical shape of the interior of crucible 60, is defined by the parameters in table 2.

TABLE 2

Load Parameters

| Load Parameter | Value of Parameter |
|---|---|
| Load Diameter ($D_{ld}$) | 7,200 mm |
| Height ($h_{bot}$) of Bottom Load Zone | 300 mm |
| Height ($h_{top}$) of Top Load Zone | 1,000 mm |

Figure 1:
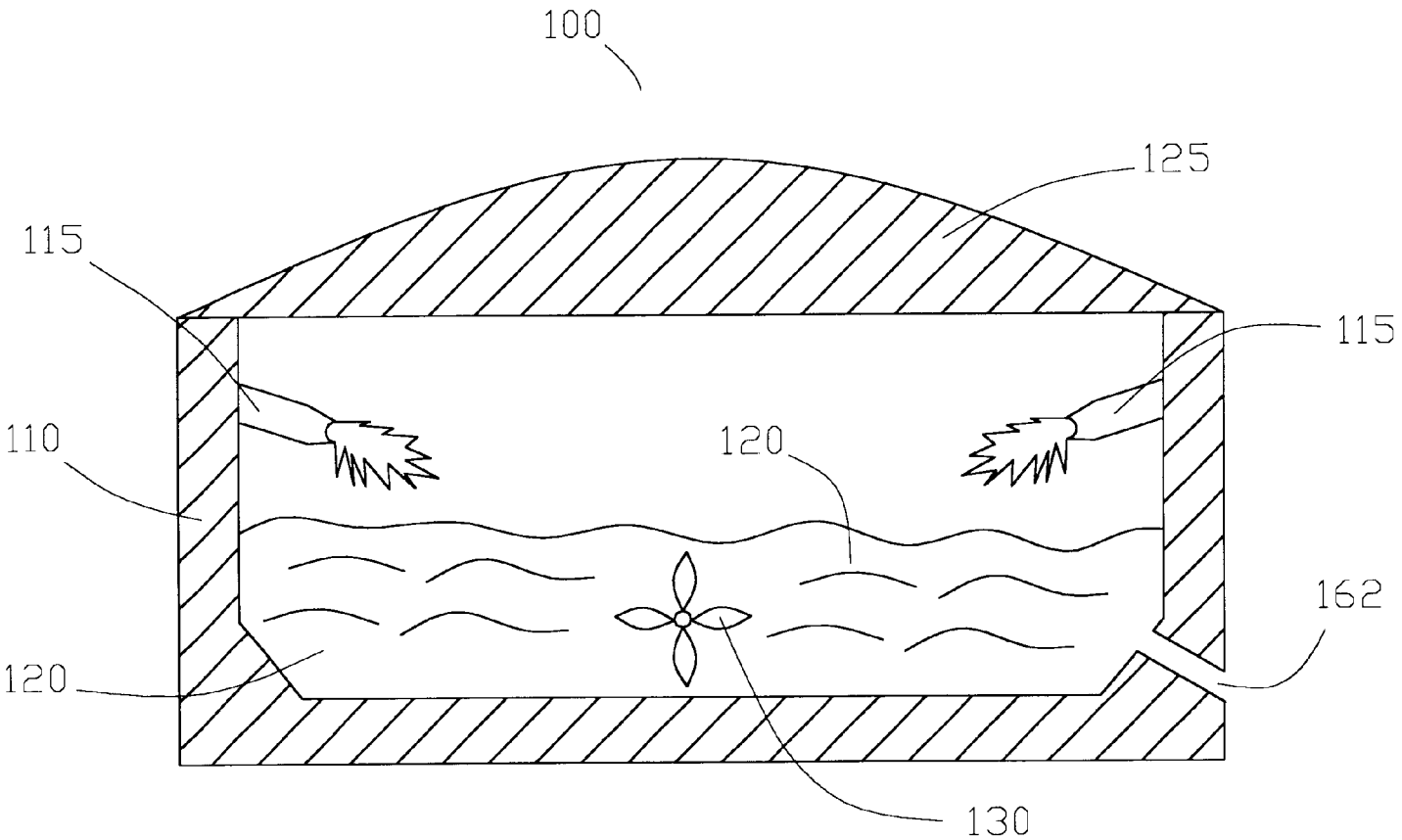
PRIOR ART FIG. 1
FIG. 1 is a cross sectional view of a typical fossil fuel-fired reverberatory furnace.
Figure 2:
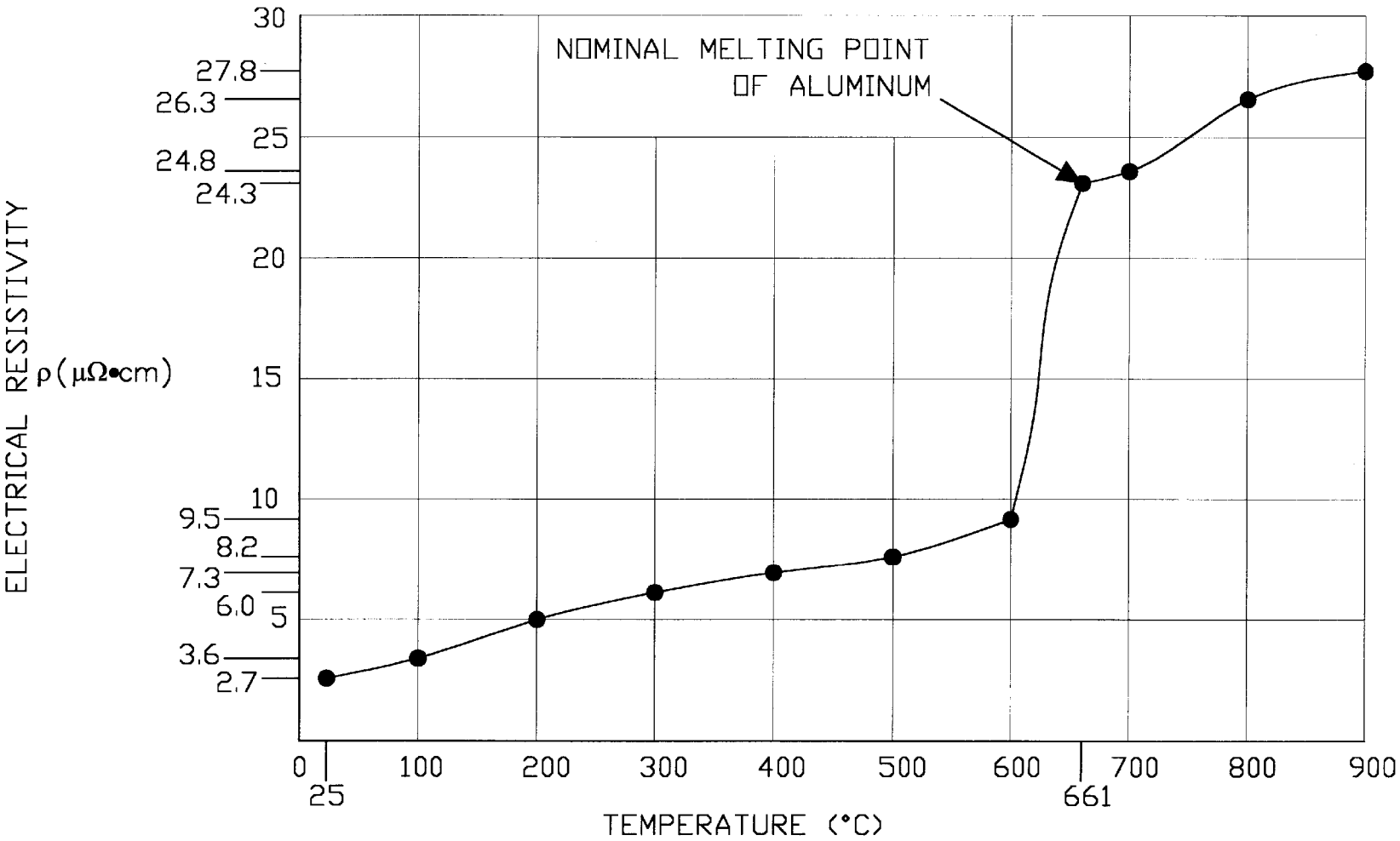
FIG. 2 is a graph illustrating the electrical resistivity of aluminum over a temperature range.

The load parameters in this example define a crucible with an interior load volume having a diameter to height ratio of approximately 5.5:1 (7,200 mm/1,300 mm). This provides a reasonable shallow depth of melt for a metal load with a relatively low value of thermal resistivity and high electrical resistivity. As illustrated in FIG. 2, the electrical resistivity ($\rho$) rises significantly at and above the melting point of aluminum. A crucible with an internal load volume having a diameter to height ratio approximately in the range from 3:1 to 6:1 is preferable.

In the first application, sufficient heat is supplied by magnetic induction to the molten aluminum load to melt solid aluminum (having an average resistivity of approximately 6 $\mu\Omega\cdot$cm) in the top metal load zone inside of the crucible, and maintain molten aluminum in the bottom load zone of the crucible. In this first application, induction furnace 10 operates as an aluminum melting furnace. 60 Hertz power is supplied from one or more suitable power sources to establish the output characteristics in table 3.

TABLE 3

Power Supply Output Characteristics

| Electrical Parameter | Value of Parameter |
|---|---|
| Coil Voltage | 2,282 volts |
| Coil Current | 45,498 amperes |

With this 60 Hertz power applied to coil 30 in the first application, coil operating parameters are as listed in table 4,

TABLE 4

Coil Operating Parameters

| Coil Operating Parameter | Value of Parameter |
|---|---|
| Coil Losses | 636 kW |
| Coil Power | 3,836 kW |
| Coil Efficiency | 83.4% |

and power transferred to the molten aluminum load is as listed in table 5.

TABLE 5

Power Transferred to Load

| Load Power Parameter | Value of Parameter |
|---|---|
| Bottom Zone Load Power | 3,198 kW |
| Top Zone Load Power | 2 kW |
| Total Load Power | 3,200 kW |

In the second application, sufficient heat is supplied by magnetic induction to the molten metal aluminum load (having an average resistivity of approximately 24.5 $\mu\Omega\cdot$cm) to maintain molten aluminum in the top and bottom load zones. In this second application, induction furnace 10 operates as a molten aluminum heating furnace. 60 Hertz power is supplied from one or more suitable power sources to establish the output characteristics in table 6.

TABLE 6

| Power Supply Output Characteristics | |
|---|---|
| Electrical Parameter | Value of Parameter |
| Coil Voltage | 2,281 volts |
| Coil Current | 45,464 amperes |

With this 60 Hertz power applied to coil 30 in the second application, coil operating parameters are a listed in table 7,

TABLE 7

| Coil Operating Parameters | |
|---|---|
| Coil Operating Parameter | Value of Parameter |
| Coil Losses | 634 kW |
| Coil Power | 3,834 kW |
| Coil Efficiency | 83.5% |

and power transferred to the molten aluminum load is as listed in table 8.

TABLE 8

| Power Transferred to Load | |
|---|---|
| Load Power Parameter | Value of Parameter |
| Bottom Zone Load Power | 3,196 kW |
| Top Zone Load Power | 4 kW |
| Total Load Power | 3,200 kW |

In both applications, forced cooling air flowing through plenum 50 is used to cool coil 30. The flow rate of cooling air at an air temperature rise, At, equal to 30° C. around coil 30 is 970 $m^3$/min for the first application, and 973 $m^3$/min for the second application. Both applications illustrate that induction furnace 10 of the present invention achieves an efficiency greater than 80 percent with induction coil losses low enough so that air cooling, rather than water cooling, can be utilized.

Additionally in an initial furnace startup when solid aluminum is placed in the bottom load zone of the crucible, induction furnace 10 will melt the solid aluminum much faster than a prior art fossil fuel-fired furnace.

The foregoing embodiments do not limit the scope of the disclosed invention. The scope of the disclosed invention is further covered in the appended claims.

What is claimed is:

1. An induction furnace for heating an electrically conductive material, comprising:

a crucible to contain the electrically conductive material;

a bottom support structure to support the bottom of the crucible, the bottom support structure having passages therein for the transmission of an electromagnetic field;

a magnetic flux concentrator disposed below the bottom support structure; and an at least one induction coil disposed between the bottom support structure and the magnetic flux concentrator, the at least one induction coil formed from an at least one active coil section and an at least one passive coil section whereby a magnetic field generated by a flow of current through the at least one induction coil penetrates the electrically conductive material to induce an eddy current in the electrically conductive material that heats the electrically conductive material.

2. The induction furnace of claim 1 wherein the crucible forms a substantially cylindrical volume for containing the electrically conductive material, the substantially cylindrical volume having a diameter to height ratio in the range of approximately 3:1 to 6:1.

3. A method of heating an electrically conductive material comprising the steps of:

supporting a crucible on a bottom support structure having passages therein for the transmission of an electromagnetic field;

placing the electrically conductive material in the crucible;

generating a primary magnetic field from the flow of a current from an ac power source through at least one active coil section of at least one induction coil disposed below the bottom support structure;

placing a magnetic flux concentrator below the at least one induction coil;

directing the primary and secondary magnetic fields towards the bottom of the crucible at least partially through the passages in the bottom support structure; and inducing a secondary current in at least one passive coil section of the at least one induction coil by magnetically coupling the at least one passive coil section to the primary magnetic field generated by the at least one active coil section, the secondary current generating a secondary magnetic field exterior to the at least one passive coil section;

magnetically coupling primary and secondary magnetic fields with the electrically conductive material in the crucible to inductively heat the electrically conductive material.

4. The method of claim 3 wherein the frequency of the current is adjusted to electromagnetically stir the electrically conductive material.

5. An induction furnace for heating an electrically conductive material, comprising:

a crucible to contain the electrically conductive material;

a bottom support structure to support the bottom of the crucible;

a magnetic flux concentrator disposed below the bottom support structure, the magnetic flux concentrator comprising a plurality of discrete ferromagnetic elements disposed in a non-electrically conductive material; and an at least one induction coil disposed between the bottom support structure and the magnetic flux concentrator, whereby a magnetic field generated by a flow of an ac current through the at least one induction coil penetrates the electrically conductive material to induce an eddy current in the electrically conductive material that heats the electrically conductive material.

6. An induction furnace for heating an electrically conductive material, comprising:

a crucible to contain the electrically conductive material, the crucible having a circular bottom;

a bottom support structure to support the bottom of the crucible;

a magnetic flux concentrator disposed below the bottom support structure, the magnetic flux concentrator comprising an inner central ring element, an outer perimeter ring element, and a plurality of transverse elements, the plurality of transverse elements spaced radially between and connected to the inner central ring element and the outer perimeter ring element; and an at least one induction coil disposed between the bottom support structure and the magnetic flux concentrator, whereby a magnetic field generated by a flow of an ac current through the at least one induction coil passes through at least the openings between the plurality of transverse elements of the magnetic flux concentrator and penetrates the electrically conductive material to induce an eddy current in the electrically conductive material that heats the electrically conductive material.

7. An induction furnace for heating an electrically conductive material, comprising:

a crucible to contain the electrically conductive material;

a bottom support structure to support the bottom of the crucible;

a magnetic flux concentrator disposed below the bottom support structure; and an at least one induction coil disposed between the bottom support structure and the magnetic flux concentrator, the at least one induction coil comprising:

an at least one active induction coil section, each of the at least one active induction coil section connected to an ac power supply; and an at least one passive induction coil section connected to a capacitor to form a resonant circuit, whereby a magnetic field generated by a flow of an ac current through the at least one active induction coil section penetrates the electrically conductive material to induce an eddy current in the electrically conductive material, and the magnetic field couples with the at least one passive induction coil section to induce a secondary current flow through the at least one passive induction section to generate a secondary magnetic field that penetrates the electrically conductive material to induce an eddy current in the electrically conductive material that heats the electrically conductive material.

8. The induction furnace of claim 7 wherein the at least one active induction coil section and the at least one passive induction coil section are disposed interior and exterior to each other.

9. The induction furnace of claim 7 wherein the at least one active induction coil section and the at least one passive induction coil section are interspaced with each other.

10. The induction furnace of claim 1 further comprising a plenum formed between the magnetic flux concentrator and the bottom support structure for the flow of a cooling medium to cool the at least one induction coil.

* * * * *